United States Patent [19]

Giesecke et al.

[11] 4,068,627

[45] Jan. 17, 1978

[54] STEAM GENERATOR WITH VERTICAL TUBESHEETS

[75] Inventors: Hans D. Giesecke, Washington, D.C.; Sterling J. Weems, Chevy Chase Village, Md.

[73] Assignee: Westinghouse Electric Corporation, Pittsburgh, Pa.

[21] Appl. No.: 646,813

[22] Filed: Jan. 6, 1976

[51] Int. Cl.[2] ..... F22B 1/06; B22C 13/14

[52] U.S. Cl. ..... 122/34; 165/158; 165/163

[58] Field of Search ..... 122/32, 33, 34; 165/134, 158, 163

[56] References Cited

U.S. PATENT DOCUMENTS

| | | | |
|---|---|---|---|
| 3,012,547 | 12/1961 | Ostergaard et al. | 122/32 |
| 3,129,697 | 4/1964 | Trepaud | 165/158 X |
| 3,216,400 | 11/1965 | Taylor | 122/34 |
| 3,286,696 | 11/1966 | Green et al. | 122/34 |
| 3,298,358 | 1/1967 | Alden, Jr. | 122/34 |
| 3,398,789 | 8/1968 | Wolowodiuk et al. | 165/134 |
| 3,490,521 | 1/1970 | Byerley | 165/158 |

*Primary Examiner*—Kenneth W. Sprague
*Attorney, Agent, or Firm*—F. J. Baehr, Jr.

[57] ABSTRACT

A vertically oriented steam generator has vertically oriented cylindrical tubesheets and C-shaped tubes.

10 Claims, 3 Drawing Figures

STEAM GENERATOR WITH VERTICAL TUBESHEETS

BACKGROUND OF THE INVENTION

This invention relates to steam generators for nuclear power plants and more particularly to steam gnerators having vertical tubesheets.

Significant localized corrosion of tubes has been found in a substantial number of pressurized water reactor vertical steam generators after several years of operation. This corrosion has occurred on the outer side of the tubes immediately above the tubesheet in areas where substantial deposits of solids or crud have accumulated. It is believed that the corrosion experienced results from the accumulation of crud deposits on the horizontal tubesheet as the tube temperature in the affected area increases to such a degree that steam blanketing and/or chemical concentration occur adjacent the tubes and increase the corrosion rate to such an extent as to cause thinning of the tube walls and premature failure of the tubes. Eliminating these deposits adjacent the tubes will increase the life of the tubes substantially.

SUMMARY OF THE INVENTION

In general, a heat exchanger for transferring heat from a primary fluid to a secondary fluid, when made in accordance with this invention, comprises a vertically oriented cylindrical shell portion, an upper head forming an end closure for the upper portion of the shell, a lower head forming an end closure for the lower portion of the shell. The shell portion including an upper thickened cylindrical girth band forming a tubesheet, and a lower thickened cylindrical girth band forming a second or lower tubesheet and a plurality of C-shaped tubes extending between the tubesheets to form the heat transfer surface of the heat exchanger.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
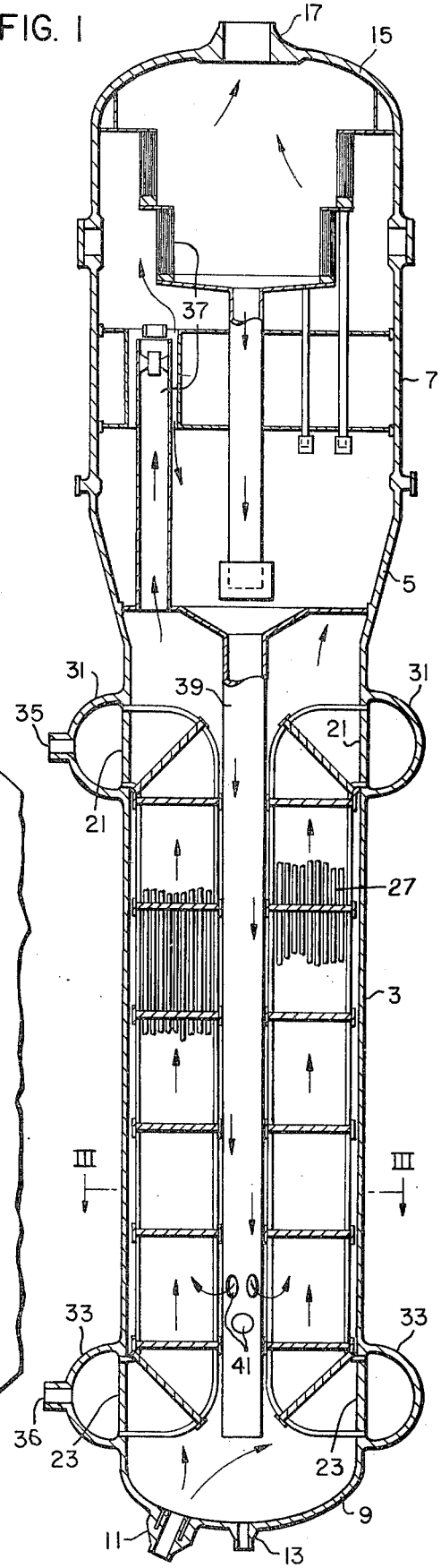
FIG. 1 is a sectional view of a steam generator made in accordance with this invention.
Figure 2:
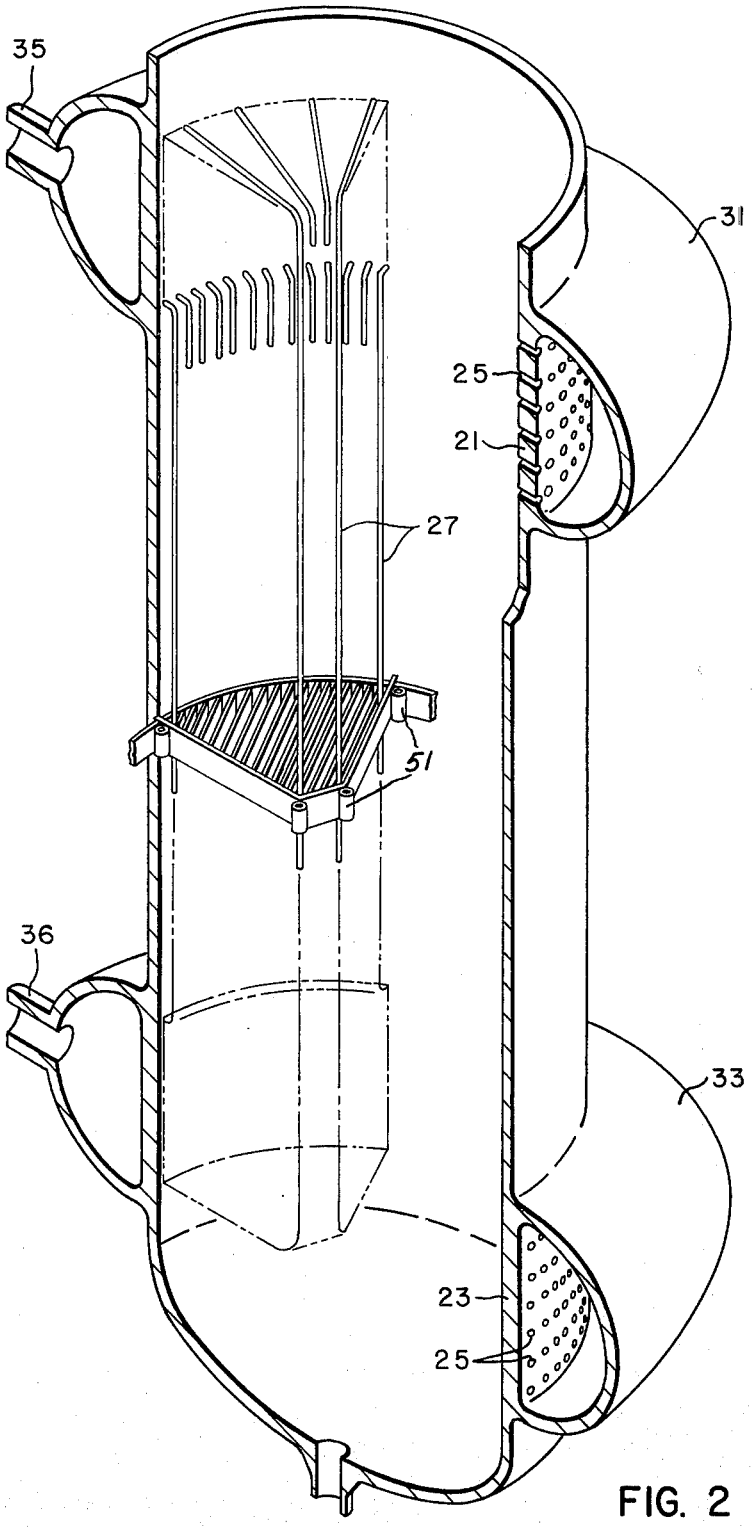
FIG. 2 is an isometric partial sectional view of the shell, tubes and tubesheets utilized in this invention.

Referring now to the drawings in detail and in particular to FIGS. 1 and 2, there is shown a vertically oriented steam generator or heat exchanger comprising a vertically oriented shell having a cylindrical lower portion 3, a frustoconical transition portion 5, and an enlarged cylindrical upper portion 7. The lower end of the shell is enclosed by a flanged and dished head 9 having a feedwater inlet nozzle 11 and a drain nozzle 13 disposed therein. The upper end of the shell is enclosed by a flanged and dished head 15 having a steam outlet nozzle 17 centrally disposed therein. The lower portion 3 of the shell as shown best in FIG. 2, has an upper and lower vertically oriented thickened cylindrical portion or girth band which forms the upper and lower vertical tubesheets 21 and 23, respectively. The tubesheets 21 and 23 have a plurality of radially disposed holes 25. A plurality of generally C-shaped tubes 27 have their ends disposed within the holes 25 in the tubesheets 21 and 23 and expanded into engagement therewith by rolling or other means. The ends of the tubes are generally seal welded to the tubesheet to provide a leak-proof structure.

The tubes 27 extend horizontally and radially from the tube sheets 21 and 23, make a 90° bend, and then extend vertically for a substantial distance to provide the heat transfer surface of the heat exchanger.

Toroidal shaped portions 31 and 33 cooperate with the tubesheets 21 and 23, respectively, to form headers for the tubes 27. A primary fluid inlet nozzle 35 is disposed in the toroidal portion 31 and a primary fluid outlet nozzle 36 is disposed in the toroidal shaped portion 33.

A two-stage moisture separator system 37 is disposed in the upper portion of the shell 7 and has a downcomer tube 39, which extends downwardly through the central portion of the lower shell portion 3 to return or recirculate moisture or water separated from the steam by the moisture separating system 37 to the lower portion of the steam generator. The downcomer 39 has a plurality of openings 41 disposed above the lower tubesheet 23. The openings 41 are so disposed that the recirculated fluid enters the tube bundles at a location where the incoming feedwater has been heated to its saturation temperature.

Figure 3:
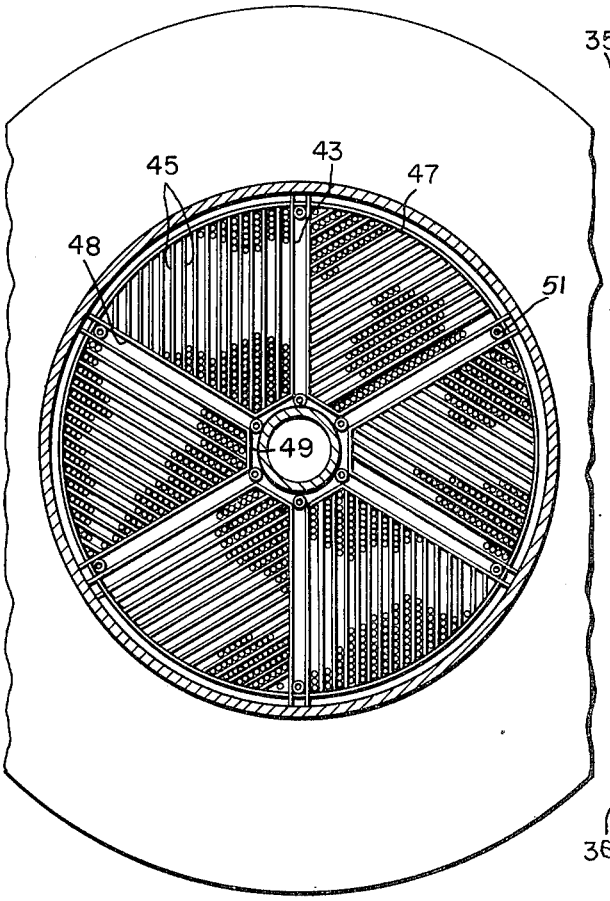
FIG. 3 is a sectional view taken on line III—III of FIG. 1.

FIGS. 2 and 3 show a plurality of wedge shaped tube bundles with a space between adjacent bundles supported by a plurality of truncated pie-shaped tube supports 43 comprising a plurality of parallel bars 45, a ring 47 disposed adjacent the shell portion 3, a plurality of radial members 48, central closing members 49 and column support portions 51 cooperatively associated to laterally support the vertical portions of the C-shaped tubes 27.

The steam generator as hereinbefore described advantageously has vertically oriented tubesheets, which prevent crud from depositing thereon, instead, crud will collect in the lower head 9 where it can be easily washed out and drained; the heat transfer characteristics are improved by providing a counterflow relationship between the primary and secondary fluid; because, the hot primary inlet is located in the boiling region of the secondary fluid and the cold primary outlet is located in the sub-cool region adjacent the feedwater inlet. There is a preheating zone, which increases the heat transfer from the primary to the secondary fluid and the tubes being C-shaped also reduce stresses caused by differential expansion between the shell and the tube to produce a highly efficient steam generator with improved life expectancy.

What is claimed is:

1. A heat exchanger for transferring heat from a primary fluid to a secondary fluid, said heat exchanger comprising:

a vertically oriented cylindrical sheel portion, said shell portion having an upper thickened cylindrical portion and a lower thickened cylindrical portion, said thickened portion having a plurality of holes so disposed to form upper and lower tubesheets integral with the shell and extending around the upper and lower portions thereof;

an upper head forming one end closure for said shell;

a lower head forming another end closure for said shell; and a plurality of C-shaped tubes, the end of which are received by said holes to form the heat transfer surface of said heat exchanger, said tubes being disposed in wedge shaped bundles with a space between adjacent bundles and being disposed to provide a central opening free of tubes extending throughout said bundles, thereby forming a heat exchanger with vertically oriented tubesheets to eliminate the buildup of crud adjacent the lower tubesheet.

2. The heat exchanger as set forth in claim 1 and further comprising a toroidal shaped portion cooperatively associated with each tubesheet to form a header for the tubes.

3. The heat exchanger as set forth in claim 1 and further comprising moisture separating means disposed in said shell and a downcomer tube for returning the separated moisture to a lower portion of the shell and to an area where the inlet secondary fluid has been heated to saturation temperature.

4. The heat exchanger as set forth in claim 3, wherein the downcomer tube is centrally disposed within the shell.

5. The heat exchanger as set forth in claim 4, wherein the downcomer tube has a plurality of openings disposed to distribute the separated moisture into the tube bundle at a location above the lower tubesheet.

6. The heat exchanger as set forth in claim 1, wherein the tubes extend horizontally from each tubesheet, make a 90° bend and have a relatively long vertical portion generally parallel to the shell.

7. The heat exchanger as set forth in claim 1 and further comprising a drain nozzle centrally disposed in said lower head.

8. The heat exchanger as set forth in claim 1, wherein said shell has an enlarged portion forming the upper end thereof and a frustoconical transition portion extending outwardly to said enlarged portion.

9. The heat exchanger as set forth in claim 8, wherein the enlarged portion the shell houses two stages of moisture separation.

10. The heat exchanger as set forth in claim 1 and further comprising a plurality of tube support racks, each rack having a plurality of parallel disposed bars cooperatively associated to laterally support the tubes.

* * * * *